United States Patent [19]

Haltof

[11] Patent Number: 4,887,389

[45] Date of Patent: Dec. 19, 1989

[54] TILT LOCK JAMBLINER AND SLIDABLE BLOCK

[75] Inventor: Garry P. Haltof, Rochester, N.Y.

[73] Assignee: Newell Manufacturing Company, Lowell, Mich.

[21] Appl. No.: 169,016

[22] Filed: Mar. 16, 1988

[51] Int. Cl.[4] ..... E05D 15/22

[52] U.S. Cl. ..... 49/181; 49/176; 49/446; 49/453

[58] Field of Search ..... 49/181, 176, 446, 172, 49/453, 161

[56] References Cited

U.S. PATENT DOCUMENTS

| | | |
|---|---|---|
| 3,012,292 | 12/1961 | Brengman . |
| 3,055,062 | 9/1962 | Peters et al. . |
| 3,124,849 | 3/1964 | Osten, Sr. . |
| 3,184,784 | 5/1965 | Peters . |
| 3,197,819 | 8/1965 | Trout . |
| 3,233,278 | 2/1966 | Ludgren . |
| 3,429,071 | 2/1969 | Philipps . |
| 3,434,236 | 3/1969 | Weidner et al. . |
| 3,462,882 | 8/1969 | Brown, Jr. . |
| 3,482,354 | 12/1969 | Trout . |
| 3,524,282 | 8/1970 | Kraft et al. . |
| 3,611,636 | 10/1971 | Trout . |
| 3,676,956 | 7/1972 | Taylor et al. . |
| 3,789,549 | 2/1974 | Yip . |
| 3,797,168 | 3/1974 | Trout . |
| 3,844,066 | 10/1974 | Nobes . |
| 3,861,082 | 1/1975 | Dau . |
| 4,068,406 | 1/1978 | Wood . |
| 4,079,549 | 3/1978 | Wood . |
| 4,227,345 | 10/1980 | Durham, Jr. . |
| 4,271,631 | 6/1981 | Trout . |
| 4,363,190 | 12/1982 | Anderson . |
| 4,364,199 | 12/1982 | Johnson et al. . |
| 4,446,654 | 5/1984 | Schoolman et al. . |
| 4,452,012 | 6/1984 | Deal . |
| 4,506,478 | 3/1985 | Anderson . |
| 4,551,881 | 11/1985 | Hoffman . |
| 4,570,382 | 2/1986 | Suess . |
| 4,610,108 | 9/1986 | Marshik . |
| 4,644,691 | 2/1987 | Wright ..... 49/181 X |
| 4,683,675 | 8/1987 | Guelck . |
| 4,683,676 | 8/1987 | Sterner, Jr. . |

*Primary Examiner*—Philip C. Kannan

*Attorney, Agent, or Firm*—Banner, Birch, McKie & Beckett

[57] ABSTRACT

The present invention is directed to a tilt lock jambliner and slidable block used with windows that both slide vertically and tilt inwardly. The window sash slides within the jambliner channel of a window frame. A pivot bar is fixedly attached to the window and is receivable within an opening in the slidable block. The slidable block is slidably mounted within the jambliner channel. The slidable block has a plurality of projections on one side which alternatingly engage a projecting fin of the jambliner channel. The projections cause the projecting fin to assume a wave shape. The interaction between the projecting fin and the lowermost projections creates constant running friction. Running friction is adjustable using a threaded friction adjusting screw mounted in the slidable block. The uppermost projections form a V and have sharp locking corners. When the sash is rotated, the biasing mechanism rotates the slidable block and forces the projections to engage the projecting fin and lock the slidable block and the sash in position.

33 Claims, 4 Drawing Sheets

TILT LOCK JAMBLINER AND SLIDABLE BLOCK

TECHNICAL FIELD

The present invention relates to an improved device for facilitating tilting and removal of a window sash. More particularly, the present invention relates to a novel slidable block and jambliner which provides constant running friction for a sash and which locks the sash in position to allow tilting and removal of the sash.

BACKGROUND OF THE INVENTION

Tilt out windows for use with removable and nonremovable windows are well known. Often such windows are provided in a double hung window system. Such window systems greatly aid washing the windows and replacing window panes. Windows of this type use known counterbalancing mechanisms for holding the window in an open or closed position. Such counterbalancing mechanisms often include a counterweight, a block and tackle unit, a spring mechanism, or some combination thereof. The counterbalancing mechanism is disposed in the jamb channels and is usually connected at one end to the jamb channels and at the other end to the window sash either directly or indirectly.

It is highly desirable to positively retain the counterbalancing mechanism in a fixed position when tilting or removing the window sash. This eliminates the need for the weight of the sash to offset the force of the counterbalancing mechanism and prevents the counterbalancing mechanism from moving upward uncontrollably and deforming or damaging.

Numerous slidable block type devices for securing the window sash within a jamb channel, connecting the sash to a counterbalancing mechanism, and locking the sash have been used. U.S. Pat. No. 3,524,282 issued to Kraft discloses a sash guiding and balancing apparatus in which sash carrier locks connect a sash to a balancing mechanism within a jamb channel. The sash carrier lock rotates upon rotation of the sash and its edge is wedged into the side wall of the jamb channel to lock the sash in position.

In U.S. Pat. No. 4,364,199 to Johnson, the sash rides on a window connector which engages a rotatable cam disposed within a slidable block within the jamb channel. The slidable block has slots, and tracks of the jamb channel ride within the slots. Rotation of the cam is caused by rotation of the window sash. Cam rotation causes the channel tracks to be forced to engage the sides of the slots in the slidable block. Thus, this device requires a cam rotatable within the slidable block.

Deal, U.S. Pat. No. 4,452,012 is directed to a pivot shoe that also uses a cam rotatable with a slidable block portion. In Deal, the slidable block portion has an element which forcibly engages one wall of the jamb channel when the cam is rotated. In U.S. Pat. No. 4,610,108, which issued to Marshik, rotation of a cam forces a toothed spring member to engage opposing side walls of the jamb channel and lock the window sash in position.

These patents are representative of known methods for mounting rotatable window sashes in channels so that the window sashes may be locked in a tilted position. However, none of these methods provides adequate constant running friction. Moreover, these devices suffer from numerous problems. They sometimes fail to work; they are overly complex; they require a plurality of relatively moving parts; or they are expensive and difficult to manufacture.

SUMMARY OF THE INVENTION

The present invention is superior to and improves upon prior devices. The tilt lock jambliner and slidable block of the present invention is used in windows that tilt inwardly as well as slide vertically. The slidable block slides within a channel of a jambliner. A window connector is rigidly and fixedly attached to the window sash and includes a post or pivot bar portion which engages a slot in the slidable block.

In operation, when the window sash is slid vertically in the jambliner, the window connector slides the slidable block vertically with the window. During vertical sliding motion, the slidable block provides constant sliding or running friction with the jambliner to prevent the sash from sliding upwardly due to the bias of a biasing or counterbalancing mechanism such as a spring or a block and tackle mechanism. When the sash is tilted inwardly to facilitate cleaning, repair, or replacement, the slidable block locks onto a portion of the jambliner to prevent vertical movement of the sash. Specifically, the slidable block and jambliner perform the following functions: the slidable block provides a connection between the window sash and the jambliner; the slidable block provides constant running friction between the window sash and the jambliner; the amount of running friction may be increased or decreased by an adjusting screw; and the slidable block locks onto the jambliner when the window sash is tilted inwardly to secure the sash in a specific location.

The jambliner is preferably formed of a plastic or resin Vinyl material, such as PVC (polyvinyl chloride), may be used. The jambliner forms a channel having a rear wall, two side walls, and a front wall having a vertical opening to permit insertion and sliding of the pivot bar of the window connector. Disposed substantially at the center of one side wall is a projecting fin extending along the entire length of the jambliner. The projecting fin is substantially perpendicular to the side wall and extends outwardly a distance approximately half of the width of the side wall. The other side wall is flat.

The slidable block is formed to slidably fit within the jambliner channel. Unless the sash is tilted, the slidable block is free to slide within the jambliner channel. The slidable block has two faces, on opposite sides thereof, which are disposed against the front and rear walls of the jambliner channel. The slidable block has two sides which are disposed against the two side walls of the jambliner channel. One side of the slidable block is relatively flat and is disposed against the flat side wall of the jambliner channel. The other side of the slidable block has projections which engage the projecting fin to provide constant running friction and to lock the window in a specific vertical location.

There are five projections. Each projection is disposed at a different vertical location along the side and has a surface facing a vertical center line of the side of the slidable block. Each projection is alternatingly disposed along either the right or the left edge of the side in a staggered relationship so that the projecting fin of the jambliner may be disposed between and weaved through alternating left projections and right projections. Thus, the projecting fin weaves around each projection substantially along the center line of the side of the slidable block. The perpendicular distance between the center line facing surfaces of the left projections and the right projections is slightly less than the thickness of the projecting fin of the jambliner.

Of the five projections, the lower three "friction projections" are used to provide constant running friction with the jambliner projecting fin. The upper three "locking projections" lock the slidable block on the jambliner projecting fin. The middle of the five projections assists in locking as well as providing running friction. The three friction projections have center line facing surfaces that are approximately 3–8 times longer (in a vertical direction parallel with the center line) than the three locking projections. The three locking projections are very close to each other in the vertical direction and form a V-shaped central opening for passage and locking of the jambliner projecting fin. The arms of the V, formed by the surfaces facing the center line, extend away from the center line toward respective left and right edges of the side surface. The arms of the V funnel the projecting fin between parallel surfaces located at the vertex of the V which lockingly engage the projecting fin.

A biasing mechanism such as a spring or a block and tackle device is attached at one end to the top of the jambliner and is attached at its other end to the slidable block. It is attached to the slidable block through a hole provided adjacent the side of the slidable block without projections. The biasing mechanism supplies an upward force on the slidable block.

A threaded friction adjusting screw is disposed in a threaded hole formed between the two faces of the slidable block. The position of this screw may be adjusted to extend outwardly of the slidable block face adjacent the rear wall of the jambliner channel. As it extends further outwardly, it increases the pressure between the slidable block and the front and rear walls of the jambliner channel. This provides an additional amount of adjustable running friction. The screw may increase the amount of friction to a point where the window sash is locked in position and cannot move at all.

Also disposed through the slidable block between its two faces is an opening having a shape that accommodates the generally rectangular pivot bar of the window connector. When the sash is moved vertically within the jambliner channel, the pivot bar engages the sides of this opening and causes the slidable block to slide vertically therewith. The opening also permits the pivot bar to rotate therein as the window is tilted. When the window is tilted, the pivot bar rotates into an angled depression in the lower left corner of the opening, a position in which it does not engage the ledge forming the rectangular portion of the opening. This relieves the force exerted by the sash from the slidable block. When the window sash is in a vertical position, the pivot bar disposed in the slidable block opening counters the rotational forces created by the biasing mechanism on the slidable block. When the window is tilted, the pivot bar no longer counters these forces and the slidable block rotates to a locked position.

The general outline of the face of the slidable block is asymmetrical, permitting it to pivot within the jambliner around a central axis perpendicular to its faces and between its two sides. The slidable block pivots from an unlocked position to a locked position. In the unlocked position, the projecting fin of the jambliner passes through the lower three friction projections of the slidable block (which provide running friction) and the upper locking projections which do not inhibit movement of the projecting fin therebetween. In the locked position, the locking projections of the slidable block are pivoted to engage the projecting fin and lock the slidable block in one vertical position. Of the surface edges along the center line, the lowermost corner of the upper locking projection, both corners of the lower locking projection, and the uppermost corner of the middle projection pointedly engage the projecting fin to lock the slidable block.

The relative dimensions of the projecting fin and the distances between the projections cause the projecting fin to weave around the projections, thereby creating a "wave" shape. A wave having a longer wavelength and a smaller amplitude is formed around the friction projections. These projections have rounded edges and provide friction only. A wave having a shorter wavelength and a larger amplitude is formed around the locking projections. These have sharp edges and lock the slidable block in the jambliner channel. The use of alternating projections which lock the projecting fin within the V shape is vastly superior to merely providing a V-shaped wedge.

When the sash is rotated, the slidable block locks. However, rotating the sash does not directly force the slidable block to rotate into its locked position. When the sash is rotated, the pivot bar rotates into the angled depression in the lower left corner of the pivot bar receiving opening. It no longer restricts the position of the slidable block against the force couple created by the linear force of the biasing mechanism and it no longer forces the slidable block to remain in the unlocked position against the biasing mechanism torque. The biasing mechanism continues to provide an upward force on the slidable block unbalanced by the weight of the sash. Because the biasing mechanism applies its force adjacent the relatively flat side, this creates a moment of rotation or force couple around the central axis, causes the slidable block to rotate into the locked position, and causes the locking projections to securely engage the jambliner projecting fin.

The slidable block and jambliner combination is superior to prior similar systems. The present invention does not require precise tolerances for the jambliner channel or the position of the projecting fin because the projecting fin is straddled. Opposing forces are placed on both sides of the projecting fin rather than between the projecting fin and the wall or between two projecting fins. This is advantageous as extrusion tolerances in forming jambliners are difficult to precisely manufacture. In the present invention, when the pivot bar is properly engaged in the slidable block opening, the slidable block will not rotate regardless of the precision of the jambliner because the pivot bar grabs and rotates the slidable block. In a similar prior system disclosed in U.S. Pat. No. 3,524,282 to Kraft, tolerances perpendicular to the vertical plane are important; the pivot bar requires a spacing relationship to tip the slidable block. If the tolerances are not accurate the slidable block will not tip or operate properly.

Various additional advantages and features of novelty which characterize the invention are further pointed out in the claims that follow. However, for a better understanding of the invention and its advantages, reference should be made to the accompanying drawings and descriptive manner which illustrate and describe preferred embodiments of the invention.

DETAILED DESCRIPTION OF PREFERRED EMBODIMENTS

Figure 1:
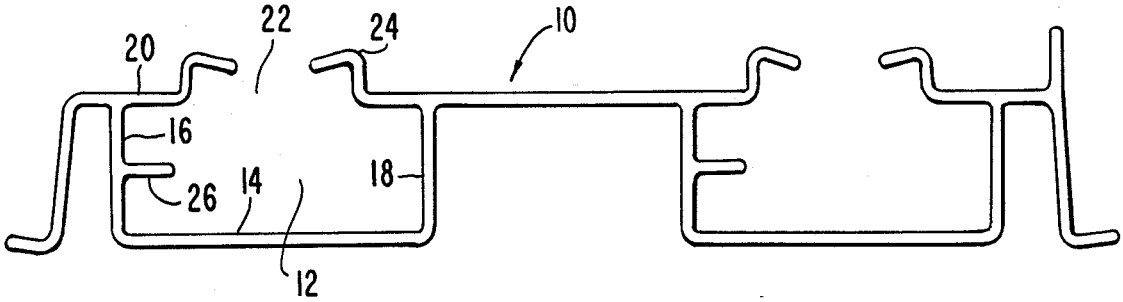
FIG. 1 is a sectional view of a jambliner according to the present invention.

The tilt lock jambliner and slidable block invention includes two primary components, the jambliner and the slidable block. As shown in FIG. 1, jambliner 10 includes a pair of channels 12 connected to each other. Preferably, jambliner 10 is made of a resilient flexible material such as PVC. Each channel 12 includes rear wall 14, first side wall 16, second side wall 18, and front wall 20. Front wall 20 has a vertical elongated slot 22 along its entire length. Slot 22 is located substantially centrally between first side wall 16 and second side wall 18. Preferably, front wall 20 includes flexible resilient ribs 24 which extend slightly outwardly away from rear wall 14. Projecting fin 26 extends perpendicularly from first side wall 16 along the entire length of first side wall 16 and into channel 12. Second side wall 18 is substantially flat.

Sash holder or slidable block 30 is formed to fit within channel 12 as shown in FIGS. 2–6. Slidable block 30 includes front face 32 and opposing rear face 34. Front face 32 and rear face 34 include wear surfaces which prevent wear on front wall 20 and rear wall 14 of jambliner channel 12. Slidable block 30 also includes first side 36 and opposing second side 38. Both first side 36 and second side 38 are angled slightly inwardly. First side 36 includes upper portion 36*a* and lower portion 36*b*. Second side 38 includes upper portion 38*a* and lower portion 38*b*. Upper portion 36*a* and lower portion 38*b* are parallel to each other and lower portion 36*b* and upper portion 38*a* are parallel to each other. This configuration for first side 36 and second side 38 facilitates rotation of slidable block 30 within jambliner channel 12 around a central axis 40 as explained below.

Second side 38 is substantially flat in that it has no projections. First side 36 includes five projections—first friction projection 42, second friction projection 44, first locking projection 46, second locking projection 48, and third projection 50. Third projection 50 serves as both the third friction projection and the third projection as will be explained below. The three lowermost projections, first friction projection 42, second friction projection 44, and third projection 50, provide constant running friction for slidable block 30 by causing projecting fin 26 of jambliner channel 12 to weave around and through these projections along vertical center line 52 of slidable block 30. The three uppermost projections, first locking projection 46, second locking projection 48, and third projection 50, provide sufficient friction to lock slidable block 30 in position within jambliner channel 12 by causing projecting fin to weave between these projections.

It is known that members, such as projections 42–50, will be acted on by forces when the projections deform a resilient rib, such as projecting fin 26, which extends from a wall. As the projecting fin bends into a wave shape, normal forces are imposed on the projections. These forces are directly proportional to the amplitude and inversely proportional to the wavelength of the wave. That is, as the amplitude increases and as the wavelength decreases, the forces increase. These forces provide frictional resistance to the movement of the projections (and the slidable block of which they are part) along the projecting fin.

Figure 2A:
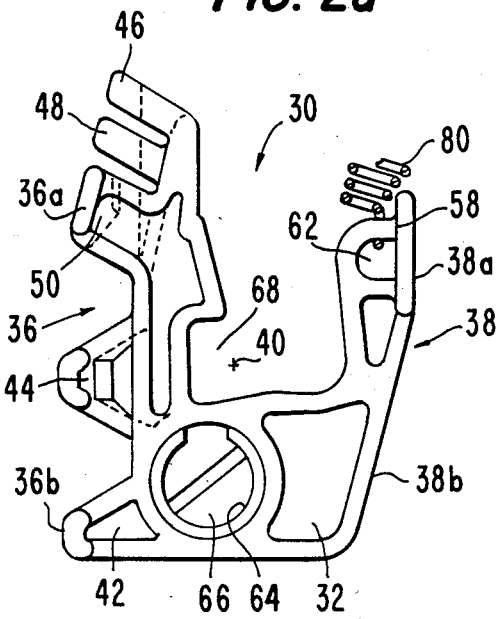
FIG. 2*a* is a front view of a slidable block according to the present invention.
Figure 3:
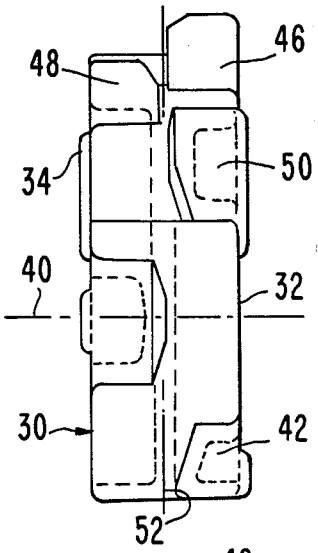
FIG. 3 is a side view of the slidable block of FIG. 2.
Figure 4:
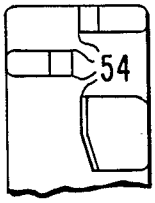
FIG. 4 is a partial side view of the projections of the slidable block of FIG. 2.
Figure 7:
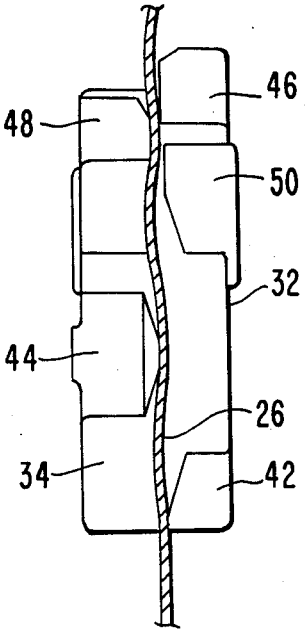
FIG. 7 is a view showing the projecting fin of the jambliner channel assuming its wave shape as it passes around the projections of the slidable block.

As shown in FIGS.2*a* and 3, each projection 42–50 is disposed at a different vertical location along first side 36. Each of the projections has a surface facing vertical center line 52 and the projections are alternatingly disposed on opposite right and left sides of vertical center line 52 in a staggered relationship. This permits projecting fin 26 to be weaved through alternating right-disposed projections (first friction projection 42, first locking projection 46, and third projection 50) and left-disposed projections (second friction projection 44 and second locking projection 48). The perpendicular distance between the center line facing surfaces of the right and left projections is less than the thickness of the projecting fin. This permits the projections to provide constant running friction and to lock slidable block 30 in position. When slidable block 30 is in its vertically slidable position, projecting fin 26 weaves around the lowermost projections substantially along vertical center line 52 to form a wave shape known for the purposes of this invention as a "friction wave." That is, due to the relative dimensions of projections 42–50 and projecting fin 26, projecting fin 26 takes the form of wave as shown in FIG. 7. This friction wave has a relatively longer wavelength and a relatively smaller amplitude as will be explained below.

Figure 6A:
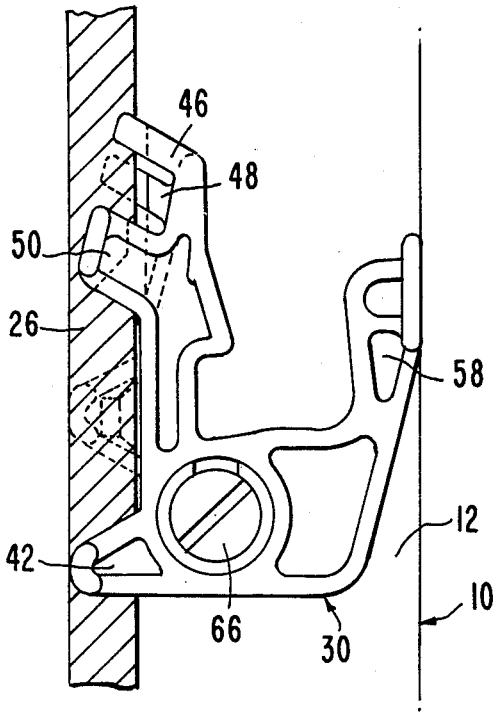
FIG. 6*a* is a front view of the slidable block disposed in the jambliner in the unlocked position.
Figure 6B:
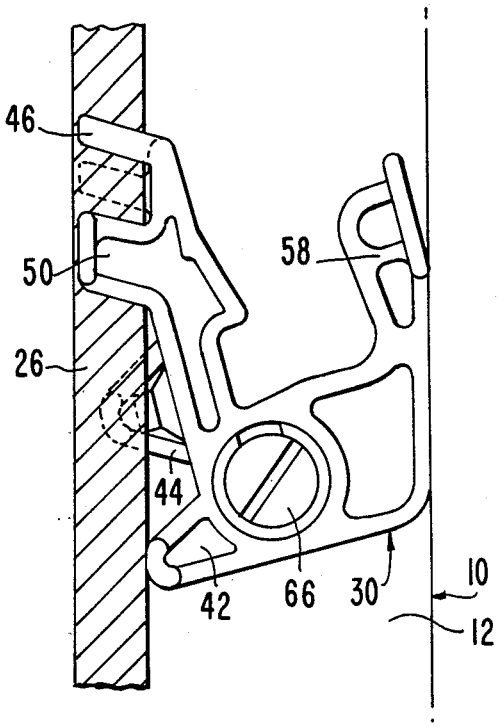
FIG. 6*b* is a front view of the slidable block disposed in the jambliner in the locked position.

The three uppermost projections 46, 48, 50 are closer together vertically than the three lowermost projections 42, 44, 50. Also, the three uppermost projections 46, 48, 50 have shorter perpendicular distances across vertical center line 52 than the three lowermost projections 42, 44, 50. Thus, there is less clearance for projecting fin 26 between projections 46, 48, 50. This reduced clearance enables the three uppermost projections 46, 48, 50 to lockingly engage projecting fin 26 and secure slidable block 30 in position. This locking is further facilitated by locking corners 54 disposed on the three uppermost projections 46, 48, 50. The lower corner of the edge of first locking projection 46, both corners of the edge of second locking projection 48, and the upper corner of the edge of third projection 50 are sharp locking corners 54 which engage projecting fin 26. Locking projection 46, 48, 50 are upwardly facing with respect to jambliner 10 and remain so in both the unlocked and locked positions as shown in FIGS. 6*a* and 6*b*. This insures that slidable block 30 is forced onto projecting fin and into a locked position by biasing mechanism 80 as slidable block 30 is rotated. This also secures a strong locking of slidable block 30 when the biasing force increases.

Figure 5A:
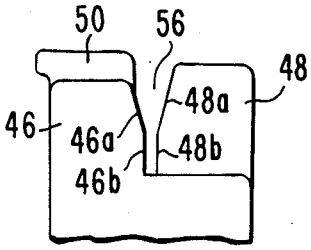
FIG. 5*a* is a partial side view of the projections of FIG. 4.
Figure 5B:
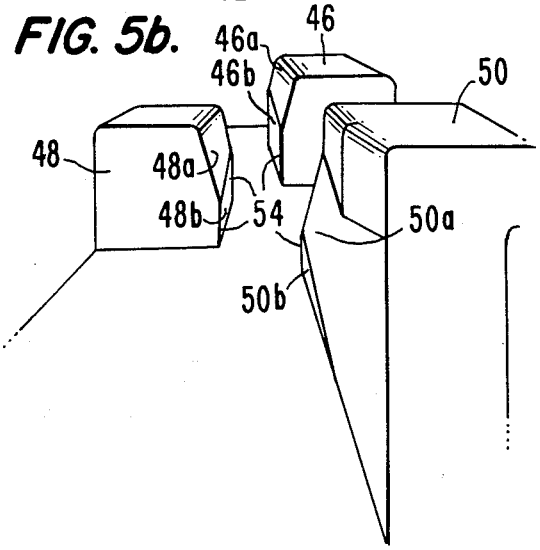
FIG. 5*b* is a perspective view of the projections of FIG. 4 viewed from the opposite side.
Figure 2B:
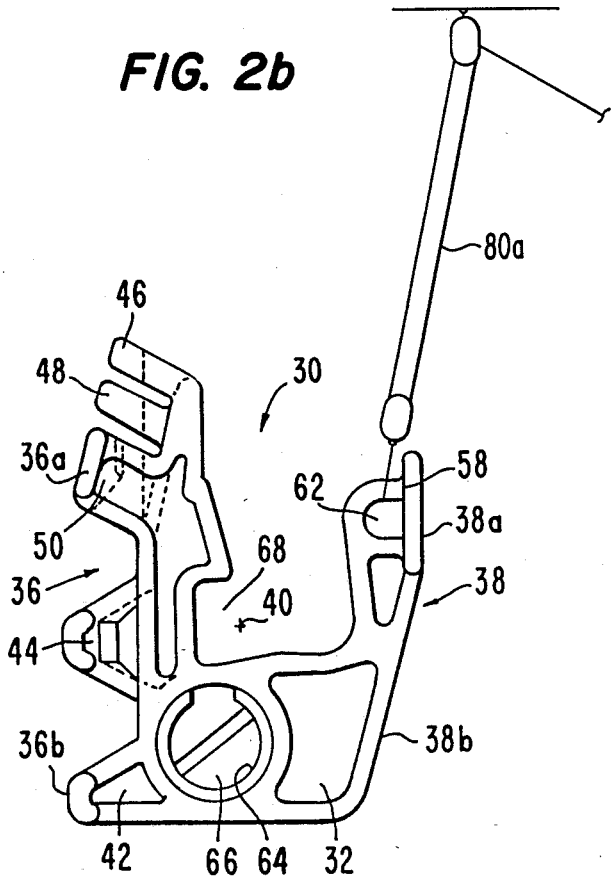
FIG. 2*b* is a view similar to FIG. 2*a* of an alternative slidable block according to the present invention.

Furthermore, first locking projection 46, second locking projection 48, and third projection 50 form V-shaped central opening 56 for passage and locking of projecting fin 26, as shown in FIGS. 5*a* and 5*b*. FIG. 5*a* is a side view of the projections viewed from the top of slidable block 30. FIG. 5*b* is a perspective view of the projections viewed from the bottom of slidable block 30. The arms of the V are formed by the surfaces facing vertical center line 52 which extend away from center line 52. Projecting fin 26 is forced to weave around projections 46, 48, 50 substantially along vertical center line 52 to form a wave shape known for the purposes of this invention as a "locking wave." In the preferred embodiment shown in FIGS. 5*a* and 5*b*, first locking projection 46 includes V surface 46*a* and parallel surface 46*b*, second locking projection 48 includes V surface 48*a* and parallel surface 48*b*, and third projection 50 includes V surface 50*a* and parallel surface 50*b*. V surfaces 46*a*, 48*a* 50*a* form V-shaped central opening 56, which funnels projecting fin 26 into the vertex of the V. Parallel surfaces 46*b*, 48*b*, 50*b* are parallel to each other and are located at the vertex of the V. Parallel surfaces 46*b*, 48*b*, 50*b* are spaced closely together and serve as the locking surfaces for projecting fin 26.

The locking wave formed by projecting fin 26 within the three uppermost projections 46, 48, 50 has a shorter wavelength and a larger amplitude than the friction wave formed by projecting fin 26 as it passes through the three lowermost projections 42, 44, 50. This decreased wavelength and increased amplitude provide greater frictional resistance. Thus, the locking wave deforms the projecting fin more than the friction wave of increased wavelength and decreased amplitude. This highly deformed state of the locking wave forces the tightly spaced, sharp edged parallel surfaces 46*b*, 48*b*, 50*b* to engage and dig into projecting fin 26. In one embodiment, at the base of the three locking projections, the gap between the projections, that is the distance between parallel surfaces 46*b*, 50*b* and parallel surface 48*b*, preferably is 0.020 inch wide. The projecting fin width is 0.040 inch wide. The gap between the lower three friction projections is 0.025 inches wide. However jambliner channels and slidable blocks having different sizes and different dimensions may be used in different applications such as with windows of varying size.

The friction and locking waves are formed by the bending of projecting fin 26. Ordinarily, projecting fin 26 is straight. However, projecting fin 26 is forced to bend around projections 42, 44, 46, 48, 50 as slidable block 30 passes. The bending of projecting fin 26 into a wave causes it to contact the projections and this causes friction. Due to the distances between the projections, a friction projection wave is formed around first friction projection 42, second friction projection 44, and third projection 50. Because of decreased distances, the amount of friction is greater and therefore forms a locking wave around first locking projection 46, second locking projection 48, and third projection 50.

Slidable block 30 also includes biasing mechanism receiving portion 58 which includes hole 62. Biasing mechanism 80 is attached at one end to the top of jambliner 10, and at its other end to hole 62 of biasing mechanism receiving portion 58 of slidable block 30. Biasing mechanism 80 counterbalances the weight of the sash and may be any conventional biasing mechanism such as a spring, (as shown in FIG. 22), a block and tackle device (as shown generally at 80*a* in FIG. 26), or any other known device or combination of devices.

Slidable block 30 also includes threaded hole 64 formed through slidable block 30 between front face 32 and rear face 34. Threaded friction adjusting screw 66 is threadedly disposed within threaded hole 64. Threaded friction adjusting screw 66 is adjustable within threaded hole 64 to extend outwardly of rear face 34 of slidable block 30. As threaded friction adjusting screw 66 extends further outwardly from rear face 34, the friction between slidable block 30 and jambliner channel 12 increases. This increases the running friction of slidable block 30 as necessary. Threaded friction adjusting screw 66 may increase the amount of running friction to a point where the window sash is locked in position.

Figure 8:
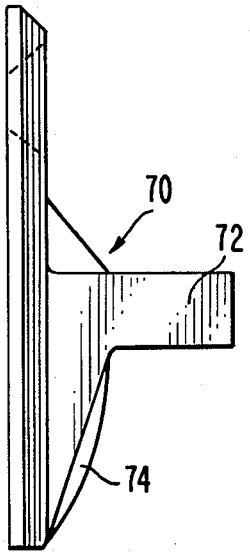
FIG. 8 is a side view of the pivot bar.
Figure 9:
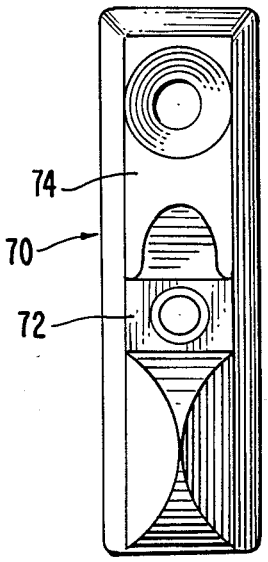
FIG. 9 is a front view of the pivot bar.
Figure 10:
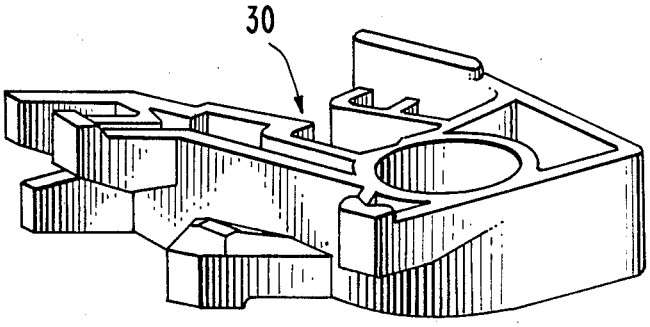
FIG. 10 is a perspective view of the slidable block.

Slidable block 30 also includes pivot bar receiving opening 68 disposed substantially centrally of slidable block 30. Pivot bar receiving opening 68 has a generally rectangular opening at one end. Pivot bar 70 is receivable in pivot bar receiving opening 68 through generally rectangular pivot bar portion 72. Pivot bar 70, shown in FIGS. 8 and 9, is fixedly mounted to a window sash through mounting portion 74.

When the window sash slides vertically within the window frame, pivot bar 70 engages slidable block 30 and slides slidable block 30 vertically within the channel. During vertically slidable motion and when the sash is at rest, this arrangement permits the window to counter the translational and rotational forces created on slidable block 30 by biasing mechanism 80. This maintains slidable block 30 and the sash in the unlocked position. In this mode, projecting fin 26 passes through the three lowermost projections 42, 44, 50 to provide constant running friction. When the sash is tilted, pivot bar 70 rotates with the sash. Pivot bar 70 is removed from engagement with the generally rectangular-shaped portion of pivot bar receiving opening 68 and into the angled depression in the lower left corner of pivot bar receiving opening 68. Pivot bar 70, and therefore the sash, relieves the force exerted by the weight of the sash from slidable block 30. This removes the force that counters biasing mechanism 80 and allows biasing mechanism 80 to provide an eccentric upward force on slidable block 30. This creates a moment of rotation and causes slidable block 30 to rotate around central axis 40 into a locked position wherein the three uppermost projections 46, 48, 50 securely engage projecting fin 26. Slidable block 30 does not have an inherent axis of rotation. When pivot bar 70 is rotated, biasing mechanism 80 causes slidable block 30 to rotate. This rotation occurs around central axis 40 which is located in the position of pivot bar 70. Slidable block 30 actually rotates about pivot bar 70. Central axis 40 is not an element or characteristic of slidable block 30; it is simply a reference axis for the rotation of slidable block 30. (If pivot bar 70 were removed, when subject to the upward force of biasing mechanism 80, slidable block 30 would move upwardly until friction causes projections 46–50 to engage projecting fin 26. Then slidable block 30 would rotate around the locking projections and lock in place.)

Due to the rotational method of locking slidable block 30 and the window in position, if the upward force of biasing mechanism 80 applied to slidable block 30 increases, the locking interference of the three uppermost locking projections 46, 48, 50 engaging projecting fin 26 increases and more securely locks slidable block 30 in position. This is because the increased force of biasing mechanism 80 forces slidable block 30 to rotate about central axis 40 and to force projecting fin 26 further between first locking projection 46, second locking projection 48, and third projection 50. In actual use, when slidable block 30 is fully rotated and the sash is fully locked, the biasing force will not increase. However, sometimes slidable block 30 will not rotate completely. In such a case, after rotating sufficiently to lock the sash, the force of biasing mechanism 80 subsequently may cause slidable block 30 to slip into a "more locked" position.

Moreover, when inserting the sash back into slidable block 30, pivot bar 70 need not be completely disposed within pivot bar receiving opening 68 before rotating the sash into its vertical position. The sash can be replaced with the following steps. First, the sash is inserted into the window frame above slidable block 30. Then the sash is rotated into its vertical position while still above slidable block 30. The sash is lowered into slidable block 30 by lowering pivot bar 70 into pivot bar receiving opening 68 around the ledge forming pivot bar receiving opening 68. As pivot bar 70 moves into position within pivot bar receiving opening 68, slidable block 30 is rotated out of its locked position.

Although projecting fin 26 need not be disposed on the centerline of its side wall 16, when projecting fin is at the center of side wall 16 slidable block 30 is functionally symmetrical about the centerline. When the slidable block is designed to operate with a centerline mounted projecting fin, the slidable block can be used on either the right or left side of the sash and separate right-handed and left-handed slidable blocks need not be manufactured. This minimizes tooling, purchasing, stocking and assembly costs.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A tilt lock jambliner and slidable block for removably securing a window sash in a window jamb and enabling the window sash to slide vertically within the window jamb and to tilt inwardly comprising:

a jambliner for mounting in the window jamb comprising at least one channel, each said channel having a plurality of walls including a front wall having a vertical elongated slot, one said wall comprising a projecting fin along at least a portion of the length of said wall; and a slidable block slidably fitting within each said jambliner channel, said slidable block having a pivot bar receiving opening, a biasing mechanism receiving portion, and a plurality of projections for engaging said projecting fin to provide constant running friction, at least one said projection being disposed on each side of said projecting fin so that said projecting fin may be disposed between and weaved through said projections to form a friction wave.

2. A tilt lock jambliner and slidable block as set forth in claim 1 further comprising means for adjusting running friction.

3. A tilt lock jambliner and slidable block as set forth in claim 1 wherein said slidable block is rotatable from an unlocked position to a locked position, and further comprising:

a generally rectangular pivot bar fixedly attached to the window sash and receivable in said pivot bar receiving opening in said slidable block, wherein when the window sash is slidable vertically within the window jamb said pivot bar engages said slidable block and slides said slidable block vertically within said channel, and said pivot bar allows the window sash to counter translational and rotational forces created on said slidable block by a biasing mechanism, maintains said slidable block in said unlocked position, and allows said projecting fin to pass through said projections to provide constant running friction, and when the window sash is tilted said pivot bar rotates and relieves the force exerted by the weight of the window sash from said slidable block and thereby removes the force that counters the biasing mechanism and allows the eccentric upward force from the biasing mechanism on said slidable block to rotate said slidable block into said locked position by causing said projections to securely engage said projecting fin.

4. A tilt lock jambliner and slidable block as set forth in claim 3 wherein said plurality of projections locks the window sash in a specific vertical location within said channel when the slidable block is rotated into said locked position.

5. A tilt lock jambliner and slidable block as set forth in claim 4 wherein in said locked position said plurality of projections engages and provides locking friction with said projecting fin by causing said projecting fin to form a locking wave.

6. A tilt lock jambliner and slidable block as set forth in claim 5 wherein said slidable block comprises five said projections, one of said projections serving as both a friction projection and a locking projection.

7. A tilt lock jambliner and slidable block as set forth in claim 5 wherein said plurality of projections comprises three friction projections and three locking projections, wherein each said projection is disposed at different vertical location and has a surface facing a vertical center line corresponding to said projecting fin, and said projections are alternatingly disposed on opposite right and left sides of said vertical center line in a staggered relationship so that said projecting fin is weaved through alternating right-disposed projections and left disposed projections and the perpendicular distance between said center line facing surfaces of said right-disposed projections and said left-disposed projections is less than the thickness of said projecting fin, wherein said three friction projections have a larger perpendicular distance than said three locking projections.

8. A tilt lock jambliner and slidable block as set forth in claim 7 wherein said friction wave is formed around said three friction projections and said locking wave is formed around said three locking projections, and wherein said friction wave has a longer wavelength and a smaller amplitude and said locking wave has a shorter wavelength and a larger amplitude.

9. A tilt lock jambliner and slidable block as set forth in claim 7 further comprising a biasing mechanism for supplying an upward force on said slidable block.

10. A tilt lock jambliner and slidable block for removably securing a window sash in a window jamb and enabling the window sash to slide vertically within the window jamb and to tilt inwardly comprising:

a jambliner for mounting in the window jamb comprising at least one channel, each channel having a rear wall, spaced apart first and second side walls, and front wall, said front wall having a vertical elongated slot along its entire length located substantially centrally between said side walls, and said first side wall having a projecting fin extending perpendicularly along the entire length and disposed substantially at the center of said first side wall;

a slidable block formed to slidably fit within each said jambliner channel, said slidable block having first and second opposing faces disposed against said front and rear walls of said jambliner channel, respectively, first and second substantially opposing sides disposed against said first and second side walls of said jambliner channel, respectively, a pivot bar receiving opening perpendicular to said first and second opposing faces, and a biasing mechanism receiving portion disposed adjacent said second opposing side, wherein said slidable block is rotatable from an unlocked position to a locked position;

said first opposing side comprising five projections for engaging said projecting fin to provide constant running friction and to lock the window sash in a specific vertical location within said channel, wherein each said projection is disposed at a different vertical location along said first side and has a surface facing a vertical center line of said first side of said slidable block, and said projections are alternatingly disposed on opposite right and left sides of said vertical center line in a staggered relationship so that said projecting fin of said channel may be disposed between and weaved through alternating said right-disposed projections and left-disposed projections, and the perpendicular distance between said center line facing surfaces of said right-disposed projections and said left-disposed projections is less than the thickness of said projecting fin, wherein said three lowermost projections have a larger perpendicular distance and provide constant running friction with said projecting fin by causing said projecting fin to form a friction wave, and wherein said three uppermost projections have a smaller perpendicular distance and provide locking friction with said projecting fin by causing said projecting fin to form a locking wave;

a biasing mechanism for supplying an upward force on said slidable block attached at one end to the top of said jambliner and attached at the other end to said biasing mechanism receiving portion of said slidable block; and a generally rectangular pivot bar fixedly attached to the window sash and receivable in said pivot bar receiving opening in said slidable block, wherein when the window sash is slidable vertically within the window jamb said pivot bar engages said slidable block and slides said slidable block vertically within said channel, and said pivot bar allows the window sash to counter translational and rotational forces created on said slidable block by said biasing mechanism, maintains said slidable block in said unlocked position, and allows said projecting fin to pass through said three lowermost projections to provide constant running friction, and when the window sash is tilted said pivot bar rotates and relieves the force exerted by the weight of the window sash from said slidable block and thereby removes the force that counters said biasing mechanism and allows the eccentric upward force from said biasing mechanism on said slidable block to rotate said slidable block around a central axis perpendicular to said first and second opposing faces and between said first and second opposing sides of said slidable block into said locked position by causing said three uppermost projections to securely engage said projecting fin.

11. A tilt lock jambliner and slidable block as set forth in claim 10 wherein the window sash is removable.

12. A tilt lock jambliner and slidable block as set forth in claim 10 wherein said jambliner comprises two channels.

13. A tilt lock jambliner and slidable block as set forth in claim 10 wherein said biasing mechanism comprises a spring.

14. A tilt lock jambliner and slidable block as set forth in claim 10 wherein said balancing mechanism comprises a block and tackle device.

15. A tilt lock jambliner and slidable block as set forth in claim 10 wherein said second side wall of said jambliner channel is substantially flat.

16. A tilt lock jambliner and slidable block as set forth in claim 10 wherein the locking force of said uppermost projections engaging said projecting fin increases and more securely locks said slidable block as the upward force of said biasing mechanism applied to said slidable block increases.

17. A tilt lock jambliner and slidable block as set forth in claim 10 wherein said jambliner is formed of a resilient, flexible material.

18. A tilt lock jambliner and slidable block as set forth in claim 17 wherein said resilient, flexible material comprises PVC.

19. A tilt lock jambliner and slidable block as set forth in claim 10 wherein said front wall of said jambliner channel comprises outwardly biased, resilient, flexible ribs for engaging the window sash.

20. A tilt lock jambliner and slidable block as set forth in claim 10 wherein said slidable block has a threaded hole formed therethrough between said first and second opposing faces, and further comprising a threaded friction adjusting screw disposed in said threaded hole formed in said slidable block, wherein said screw is adjustable within said threaded hole to extend outwardly of said second face of said slidable block to increase friction between said slidable block and said front and rear walls.

21. A tilt lock jambliner and slidable block as set forth in claim 20 wherein said threaded friction adjusting screw may increase the amount of friction sufficiently to lock the window sash in position.

22. A tilt lock jambliner and slidable block as set forth in claim 10 wherein said three uppermost projections are closer together in the vertical direction than said three lowermost projections and have locking corners to lockingly engage said projecting fin to lock said slidable block in position to facilitate tilting the window sash, at least two said uppermost projections forming a V-shaped central opening for passage and locking of said projecting fin, wherein the arms of said V shape are formed by said surfaces facing said center line extending away from said center line.

23. A tilt lock jambliner and slidable block as set forth in claim 22 wherein the vertex of said V-shaped central opening comprises substantially parallel surfaces, said arms of said V shape funneling said projecting fin into said vertex.

24. A tilt lock jambliner and slidable block as set forth in claim 22 wherein said three uppermost projections form said V-shaped central opening.

25. A tilt lock jambliner and slidable block as set forth in claim 24 wherein the vertex of said V-shaped central opening comprises three substantially parallel surfaces, two surfaces being substantially coplanar with each other and substantially parallel to said third surface, said arms of said V shape funneling said projecting fin into said vertex.

26. A tilt lock jambliner and slidable block as set forth in claim 22 wherein the lowermost corner of said uppermost projection, both corners of said second projection from the top of said slidable block, and the uppermost corner of said third projection from the top of said slidable block pointedly engage and lock on said projecting fin to lock said slidable block in position.

27. A tilt lock jambliner and slidable block as set forth in claim 10 wherein said friction wave has a longer wavelength and a smaller amplitude and said locking wave has a shorter wavelength and a larger amplitude.

28. A tilt lock jambliner and slidable block as set forth in claim 27 wherein said lowermost projections have rounded edges to provide only friction.

29. A tilt jambliner and slidable block as set forth in claim 10 wherein both said first and second opposing sides are angled slightly inwardly, wherein said first and second opposing sides have upper and lower portions and said lower portion on each said opposing side is substantially parallel to said portion on each said opposite opposing side to facilitate rotation of said slidable block within said channel around said central axis between said unlocked position and said locked position.

30. A tilt lock jambliner and slidable block as set forth in claim 10 wherein said pivot bar is insertable into said pivot bar receiving opening of said slidable block when the window sash is placed within the window jamb in a tilted position.

31. A tilt lock jambliner and slidable block as set forth in claim 10 wherein said pivot bar is insertable into said pivot bar receiving opening of said slidable block when the window sash is placed within the window jamb in a vertical position.

32. A tilt lock jambliner and slidable block as set forth in claim 10 wherein said slidable block further comprises wear surfaces on said first and second opposing faces.

33. A tilt lock jambliner and slidable lock for removably securing a window sash in a window jamb and enabling the window sash to slide vertically within the window jamb and to tilt inwardly comprising:

a jambliner for mounting in the window jamb comprising at least one channel, each said channel having a rear wall, spaced apart first and second side walls, and a front wall, said front wall having a vertical elongated slot along its entire length located substantially centrally between said side walls and comprising outwardly biased, resilient, flexible ribs for engaging the window sash, said first side wall having a projecting fin extending perpendicularly along the entire length and disposed substantially at the center of said first side wall, and said second side wall being substantially flat;

a slidable block formed to slidably fit within each said jambliner channel, said slidable block having first and second opposing faces disposed against said front and rear walls of said jambliner channel, respectively, and first and second substantially opposing sides disposed against said first and second walls of said jambliner channel, respectively, said slidable block comprising wear surfaces disposed on said first and second opposing faces, and said slidable block having a threaded hole formed therethrough between said first and second opposing faces, a pivot bar receiving opening formed therethrough between said first and second opposing faces, and a biasing mechanism receiving portion disposed adjacent said second opposing side, both said first and second opposing sides being angled slightly inwardly, wherein said first and second opposing sides have upper and lower portions and said lower portion on each said opposing side is substantially parallel to said upper portion on each said opposite opposing side to facilitate rotation of said slidable block within said channel around a central axis perpendicular to said first and second opposing faces and between said first and second opposing sides of said slidable block between an unlocked position and a locked position;

said second opposing side being substantially flat and said first opposing side comprising five projections for engaging said projecting fin to provide constant running friction and to lock the window sash in a specific vertical location within said channel, wherein each said projection is disposed at a different vertical location along said first side and has a surface facing a vertical center line of said first side of said slidable block, and said projections are alternatingly disposed on opposite right and left sides of said vertical center line in a staggered relationship so that said projecting fin of said channel may be disposed between and weaved through alternating said right-disposed projections and left-disposed projections, and the perpendicular distance between said center line facing surfaces of said right-disposed projections and said left-disposed projections is less than the thickness of said projecting fin, wherein said three lowermost projections have a larger perpendicular distance and provide constant running friction with said projecting fin by causing said projecting fin to form a friction wave, and wherein said three uppermost projections are closer together in the vertical direction than said three lowermost projections and have locking corners to lockingly engage said projecting fin to lock said slidable block in position to facilitate tilting the window sash, said three uppermost projections forming a V-shaped central opening for passage and locking of said projecting fin, wherein the arms of said V shape are formed by said surfaces facing said center line extending away from said center line, wherein the vertex of said V-shaped central opening comprises three substantially parallel surfaces, two said surfaces being substantially coplanar with each other and substantially parallel to said third surface, said arms of said V shape funneling said projecting fin into said vertex, wherein said three uppermost projections have a smaller perpendicular distance and provide locking friction with said projecting fin by causing said projecting fin to form a locking wave with said locking corners lockingly engaging said projecting fin, and wherein said lock wave has a shorter wavelength and a larger amplitude than said friction wave, and wherein the lowermost corner of said uppermost projection, both corners of said second projection from the top of said slidable block, and the uppermost corner of said third projection from the top of said slidable block pointedly engage said projecting fin to lock said slidable block in position;

a biasing mechanism for supplying an upward force on said slidable block attached at one end to the top of said jambliner and attached at the other end to said biasing mechanism receiving portion of said slidable block;

a threaded friction adjusting screw disposed in said threaded hole formed in said slidable block; wherein said screw is adjustable within said threaded hole to extend outwardly of said second face of said slidable block to increase friction between said slidable block and said front and rear walls; and a generally rectangular pivot bar fixedly attached to the window sash and receivable in said pivot bar receiving opening in said slidable block, wherein when the window sash is slidable vertically within the window jamb said pivot bar engages said slidable block and slides said slidable block vertically within said channel, and said pivot bar allows the window sash to counter translational and rotational forces created on said slidable block by said biasing mechanism, maintains said slidable block in said unlocked position, and allows said projecting fin to pass through said three lowermost projections to provide constant running friction, and when the window sash is tilted said pivot bar rotates and relieves the force exerted by the weight of the window from said slidable block and thereby removes the force that counters said biasing mechanism and allows the eccentric upward force from said biasing mechanism on said slidable block to rotate said slidable block around said central axis into said locked position by causing said three uppermost projections to securely engage said projecting fin, wherein the locking force of said uppermost projections engaging said projecting fin increases and more securely locks said slidable block as the upward force of said biasing mechanism applied to said slidable block increases, and wherein said pivot bar is insertable into said pivot bar receiving opening of said slidable block when the window sash is placed within the window jamb in a tilted or vertical position.

* * * * *